US008695496B2

(12) United States Patent
Ortner

(10) Patent No.: US 8,695,496 B2
(45) Date of Patent: Apr. 15, 2014

(54) STAMP INSERT

(75) Inventor: Manfred Ortner, Pennewang (AT)

(73) Assignee: Trodat GmbH (AT)

( * ) Notice: Subject to any disclaimer, the term of this patent is extended or adjusted under 35 U.S.C. 154(b) by 840 days.

(21) Appl. No.: 12/227,092

(22) PCT Filed: Apr. 27, 2007

(86) PCT No.: PCT/AT2007/000197
§ 371 (c)(1),
(2), (4) Date: Jul. 26, 2010

(87) PCT Pub. No.: WO2007/128012
PCT Pub. Date: Nov. 15, 2007

(65) Prior Publication Data

US 2010/0275795 A1 Nov. 4, 2010

(30) Foreign Application Priority Data

May 4, 2006 (AT) ..... A 769/2006
Sep. 1, 2006 (AT) ..... A 1460/2006

(51) Int. Cl.
*B41K 1/10* (2006.01)
*B41K 1/40* (2006.01)
*B41J 1/20* (2006.01)

(52) U.S. Cl.
USPC ..... 101/105; 101/111

(58) Field of Classification Search
CPC ..... B41K 1/10; B41K 1/40; B41J 1/20
USPC ..... 101/105, 111
See application file for complete search history.

(56) References Cited

U.S. PATENT DOCUMENTS

| | | | | |
|---|---|---|---|---|
| 4,246,841 | A | 1/1981 | Just | |
| 4,697,513 | A * | 10/1987 | Faber | 101/111 |
| 6,843,173 | B2 * | 1/2005 | Shih | 101/111 |
| 7,389,727 | B2 * | 6/2008 | Faber | 101/334 |
| 7,654,198 | B2 * | 2/2010 | Faber | 101/111 |
| 2004/0255801 | A1 * | 12/2004 | Shih | 101/111 |
| 2008/0141881 | A1 | 6/2008 | Faber | |

FOREIGN PATENT DOCUMENTS

| | | | |
|---|---|---|---|
| AT | 000 379 | U1 | 9/1995 |
| CH | 258 021 | A | 11/1948 |
| DE | 2 156 157 | A1 | 5/1973 |
| DE | 28 56 854 | A1 | 8/1979 |
| DE | 203 09 613 | U1 | 9/2003 |
| WO | WO 2004082949 | A1 * | 9/2004 |
| WO | WO-2006/079129 | A1 | 8/2006 |

* cited by examiner

*Primary Examiner* — Ren Yan
*Assistant Examiner* — Leo T Hinze
(74) *Attorney, Agent, or Firm* — Lerner, David, Littenberg, Krumholz & Mentlik, LLP

(57) ABSTRACT

The invention describes an insert element (1) for a stamp, with several setting wheels (9) disposed adjacent to one another which are rotatably mounted on a shaft (7) of an insert body (2). The setting wheels (9) are designed to support typeface belts (10). The typeface belts (10) are covered at least in the region of the setting wheels (9) by a cover element (12) which in turn has end regions (19, 20) spaced apart from one another in the direction of the shaft (7) and is provided with slots (13) through which setting wheel circumferences (11) extend. In order to couple the cover element (12) with the insert body (2), at least one coupling mechanism (15) is provided, which comprises respective co-operating coupling elements (16, 17) on the insert body (2) and on the cover element (12). The coupling elements (16, 17) are designed so that the direction of the relative coupling movement of the coupling elements (16, 17) with respect to one another is oriented approximately in the direction of the shaft (7) of the insert body (2).

17 Claims, 10 Drawing Sheets

STAMP INSERT

The invention relates to an insert element for a stamp, with several setting wheels disposed adjacent to one another which are rotatably mounted on a shaft of an insert body, and the setting wheels are designed to support typeface belts, with a cover element covering the typeface belts at least in the region of the setting wheels, which is in turn provided with slots through which setting wheel circumferences extend and with at least one coupling mechanism for coupling the cover element with the insert body.

Document AT 000 379 U1 discloses a cover plate in the form of a U-shaped metal or plastic body incorporating slots through which setting wheels extend and the cover plate covers the typeface belts mounted on wheel hubs of the setting wheels. In order to retain and secure the cover plate, the insert body has front and rear transverse parts extending between the side parts, which in turn have slots for accommodating the cover plate fitted above the typeface belts. This being the case, the cover plate with its slots can be pushed over the setting wheels into the slots provided in the insert body until the cover plate is secured in the insert body by a clamping action. However, it has not always proved possible to ensure a reliable and durable fitting between the cover plate and insert body in all applications.

Document DE 203 09 613 U1 discloses a date stamp, comprising a housing, a holder, a stamp frame and a protective cover with a U-shaped cross-section. The stamp frame in this instance is mounted on the holder so that it can be pivoted, and an ink pad is integrated in the housing. The stamp frame has several setting discs and several stamp strips, each of which is provided with a printing surface incorporating letters, numbers and/or images. In order to provide a mutual connection between the protective cover and the stamp frame, the stamp frame has two clamping parts disposed on either side at the bottom part on the one hand and the protective cover has two defined fixing parts on either side on the other hand, The fixing parts of the protective cover are disposed in the region of side wall parts thereof. The protective cover latches by means of legs which splay in the direction more or less perpendicular to the shaft of the setting discs. The deformation which occurs during coupling takes place mostly in the arch-shaped region of the U-shaped cross-section of the protective cover. It has not always proved possible to ensure that the protective cover is reliably secured on the stamp frame in all applications.

The underlying objective of this invention is to propose an insert element for a stamp, whereby the cover element can be reliably retained in an exact position on the insert body.

This objective is achieved by the invention due to the fact that the coupling mechanism comprises co-operating coupling elements on the insert body and on the cover element respectively, which are designed so that the relative coupling movement direction of the coupling elements with respect to one another is oriented approximately in the direction of the shaft of the insert body. The surprising advantage gained as a result of the features defined in the characterising part of claim 1 resides in the fact that the selected relative coupling movement direction of the co-operating coupling elements in the direction perpendicular to the U-shaped cross-section of the cover element results in an even more reliable connection as well as exact mutual positioning of the components to be coupled. This is the case irrespective of the disposition and position of the legs of the cover element relative to the insert body. The mutual orientation of the cover element with respect to the insert body also plays an important role with regard to the co-operation of the setting wheel with the slots in the cover element co-operating with them. When the cover element is secured in the correct position in the direction of the shaft, the clearance between the slot and the respective setting wheel can be kept small without resulting in any mutual contact or sliding. Flexing which occurs as the U-shaped cover element is biased forwards also has no effect on the amount of clamping force to be applied. An inadvertent separation of the components due to a displacement or movement of the legs of the cover element does not cause the coupling mechanism to be unintentionally released as a result, such as can occur when operating the setting wheels for example. This is because the coupling movement direction is selected so that it is shifted by approximately 90° with respect to the pressing force to be applied in order to transmit force during the rotating movement of the setting wheels.

Also of advantage is another embodiment defined in claim 2 because a coupling element can be obtained which is easy to manufacture using simple means and enables a reliable, strong and durable fitting to be obtained.

An embodiment defined in claim 3 is also of advantage because it ensures reliable co-operation with the coupling element provided in the form of a receiving orifice.

The embodiment defined in claim 4 or 5 makes it easier to release the mutually engaged coupling elements with a view to removing the cover element from the insert body. This being the case, the projection merely has to be moved out of engagement with the receiving orifice using an appropriate tool, after which the cover element simply has to be removed.

Another embodiment defined in claim 6 or 7 results in a coupling element which is easy to manufacture yet ensures a reliable and durable fit of the cover element on the insert body.

Also of advantage is another embodiment defined in claim 8 because the coupling element is covered by the cover element from outside.

As a result of the embodiment defined in claim 9, when the cover element is exactly positioned in the region of the shaft, it can be additionally moved in order to orient it with respect to the support plate or housing arch.

The advantage of the embodiment defined in claim 10 is that it results in a coupling movement direction directed from the outside in the direction towards the centre of the insert body, which means that it is not made more difficult or impossible for an inexperienced user to release the cover element from the insert body.

As a result of the embodiment defined in claim 11, specifically oriented contact surfaces are provided perpendicular to the fitting direction of the components to be coupled with one another, namely the cover element and the insert body, which prevent the coupling elements from being released from one another.

As a result of the embodiments defined in claim 12 or 13, the intrinsic elastic properties of the material can be used to implement the coupling operation, in which case the main body of the cover element may have a higher intrinsic rigidity.

As a result of another embodiment defined in claim 14, a certain amount of cover can be achieved for the peripherally disposed setting wheels whilst nevertheless enabling perfect coupling of the coupling elements constituting the coupling mechanism.

The advantage of the designs defined in claims 15 to 18 is that the individual wall parts of the cover element are additionally retained by the connecting web or webs and the transmitted force is also specifically directed, thereby resulting in greater stiffness of the mutually engaging coupling elements of the coupling mechanism. By disposing the connecting web in the apex portion or apex region of the U-shaped cover element, additional stiffness is imparted to it in the direction of the shaft. As a result of this connection, the slot width of the slot is kept constant in this region, thereby preventing any rubbing or jamming of the setting wheels during the setting operation.

As a result of the embodiment defined in claim 19 or 20, the leg ends of the cover element can be prevented from pivoting inwards in the direction towards the typeface belts. This not only facilitates assembly but also prevents damage and possible mutual misalignment for the setting operation, which would require a stronger force to be applied.

Finally, claims 21 to 24 define other advantageous embodiments, these advantages being explained in the description.

The invention will be explained in more detail below with reference to examples of embodiments illustrated in the appended drawings.

Of these:

Figure 1:
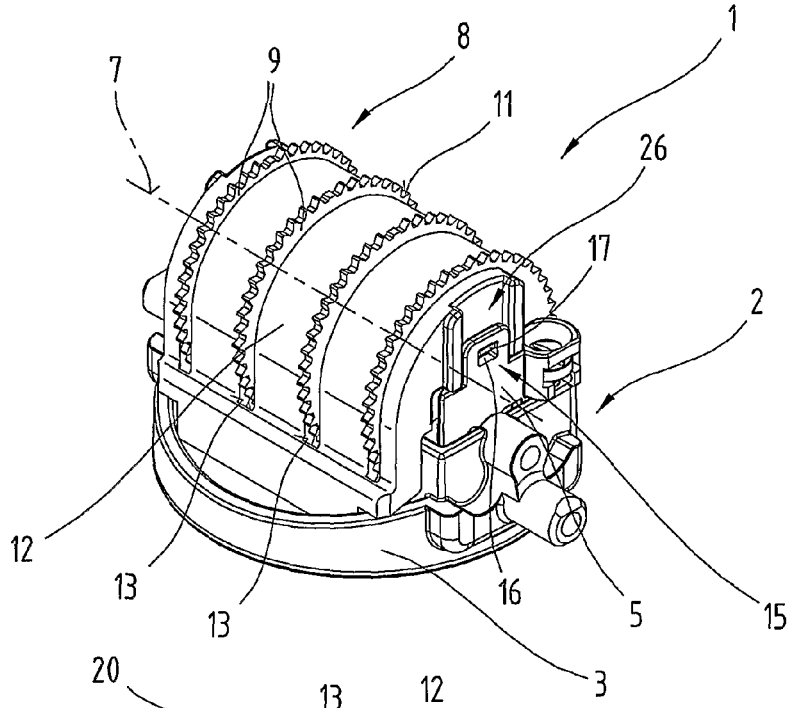
FIG. 1 is a simplified diagram illustrating an insert element for a stamp as proposed by the invention, with a coupling mechanism disposed between the cover element and the insert body in the coupled position.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
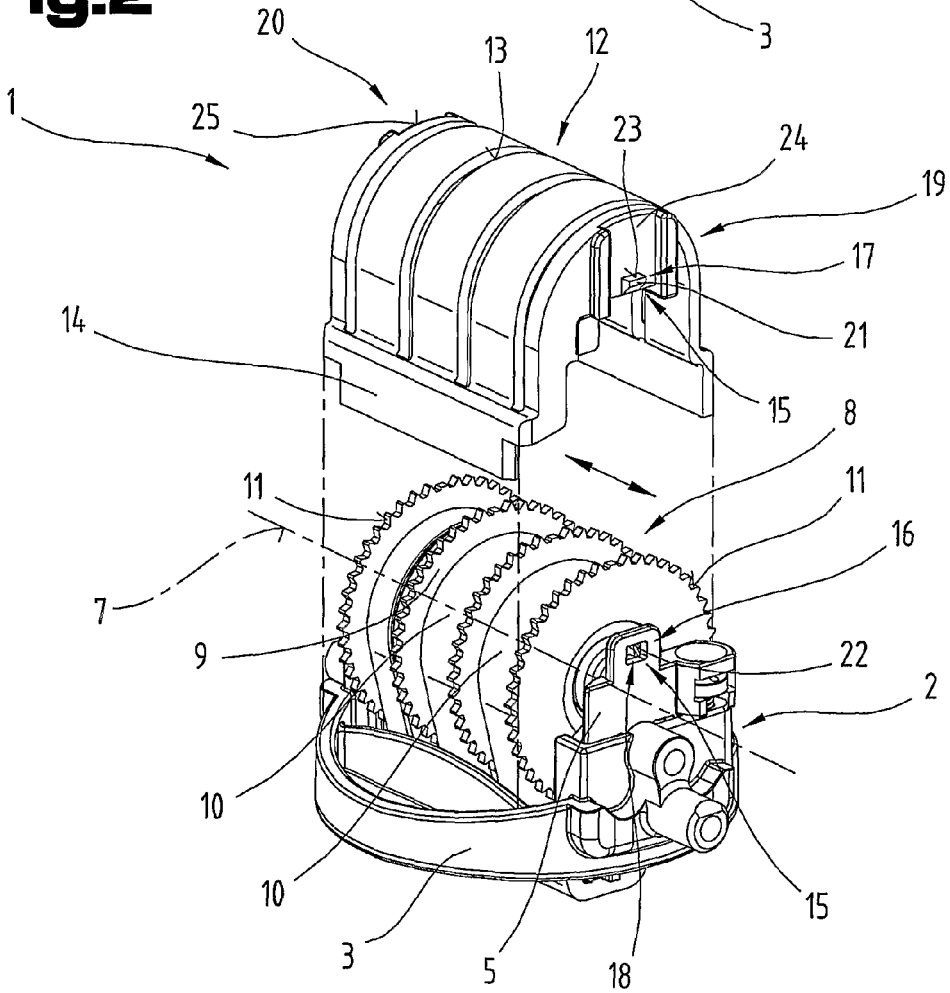
FIG. 2 is a simplified diagram illustrating the insert element shown in FIG. 1 with the cover element removed.
Figure 3:
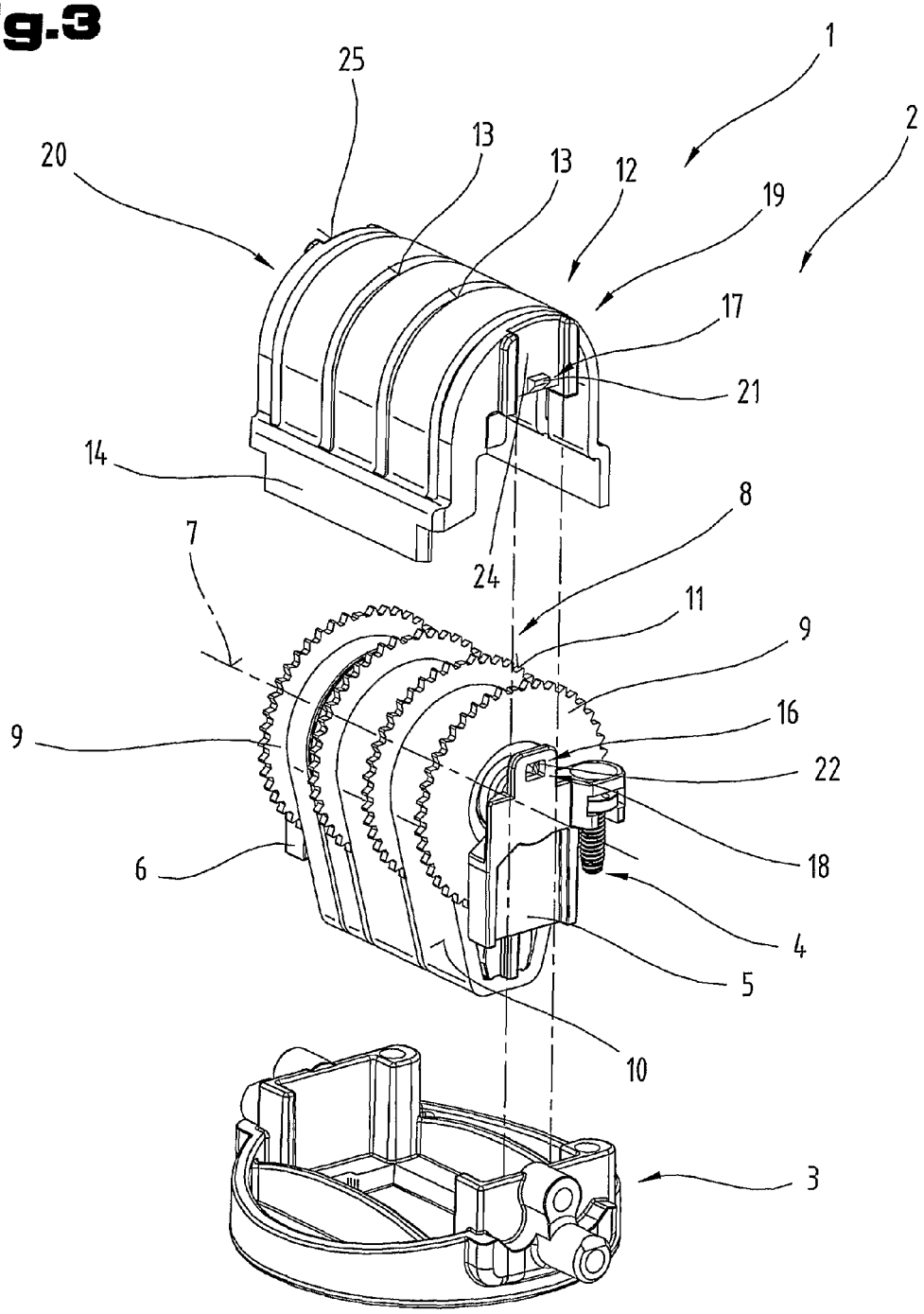
FIG. 3 is a simplified diagram illustrating the insert element shown in FIGS. 1 and 2 with the components in a position taken apart from one another.

FIGS. 1 to 3 illustrate one possible embodiment of a stamp, which may construed as an independent solution in its own right, in particular an insert element 1 with an insert body 2 for a stamp, which is designed as a date stamp for example, and which can be set to the respective date or to some other typeface and printing characters. For the sake of simplicity, only the actual insert element 1 for the stamp is illustrated since the other components which make up the stamp, such as the stamp frame and the separate inking system for the printing characters and such like, do not constitute part of this invention.

In the embodiment illustrated as an example here, the insert element 1 is provided in the form of a support plate 3, a housing arch 4 with side parts 5, 6 and a shaft 7. At its centre, the support plate 3 has an orifice for the stamp part so as to provide a perfect support on the surface to which the stamp will be applied on the one hand and to support or accommodate other print characters on the other hand.

Co-operating with the insert body 2 is a setting wheel unit 8 with several setting wheels 9, which are mounted so as to be rotatable about the shaft 7. The setting wheels 9 are used to support typeface belts 10, and the setting wheels 9 form a setting wheel circumference 11 at their external circumference. In order to cover the typeface belts 10, at least one cover element 12 is provided in the region of the setting wheel unit 8, which has mutually adjacent slots 13 aligned with the individual setting wheels 9 through which at least the setting wheel circumference 11 of the setting wheels 9 extend. The cover element 12 has a main body 14, which has a U-shaped cross-section by reference to the shaft 7. Due to the fact that the setting wheel circumferences 11 extend through the slots 13 and the main body 14 of the cover element 5 covers the typeface belts 10 disposed between the setting wheels, a user of such an insert element 1 avoids getting dirty from the stamping ink adhered to already used print characters when operating the setting wheels 9.

Depending on the printing or stamp characters, the typeface belts 10 may have a different width in the direction of the shaft 7. In the region of the support plate 3, the typeface belts 10 are provided with a guide, which will not be described in detail but which orients the printing characters disposed on the typeface belts 10 so that they are flat with respect to the stamp face and its surface. This results in a tight contact in a known manner, thereby producing a perfect stamping result.

In order to secure and couple the cover element 12 with the insert body 2, at least one coupling mechanism 15 is provided between them. This coupling mechanism 15 in turn comprises co-operating coupling elements 16, 17 on the insert body 2 or one of its components and on the cover element 12 respectively. The co-operating coupling elements 16, 17 are designed so that the relative coupling movement direction of the coupling elements 16, 17 with respect to one another is oriented approximately in the direction of the shaft 7 of the insert body 2. This means that, by reference to the U-shaped design of the main body 14 of the cover element 12, the coupling movement direction is oriented approximately perpendicular to the U-shaped cross-section. Due to the fact that the coupling movement direction is aligned more or less in the direction of the shaft 7, the cover element 12 is prevented from inadvertently working loose during the process of setting the setting wheel circumference 11 of the setting wheels 9.

A double arrow in FIG. 2 indicates the coupling movement direction of the co-operating coupling elements 16, 17, and the coupling operation starts by moving the coupling elements 17 by means of the side wall part 24, 25 in the direction facing the setting wheels 9—in other words inwards. When correctly oriented and positioned, the coupling element 17 of the cover element 12 can be moved into engagement with the first coupling element 16 in the region of the side parts 4, 5. At the same time, however, the side parts 5, 6 of the insert body may undergo an elastic deformation during the joining process.

A clearer understanding of the coupling mechanism 15 may be obtained by comparing FIGS. 2 and 3. Here, the first coupling element 16 is provided in the form of a receiving orifice 18 in the region of the side part 5, 6 of the insert body 2. In this respect, the side part 5, 6 may be part of the support plate 3 and/or the housing arch 4.

The cover element 12 comprises the main body 14 with the U-shaped cross-section and end regions 19, 20 spaced apart from one another in the direction of the shaft 7. The coupling element or elements 17, in this instance provided in the form of a projection 21, is or are disposed on the cover element 12 in the region of these end regions 19, 20. This coupling element 17 provided in the form of a projection 21 latches in the coupling element 16 provided in the form of the receiving orifice 18 when the cover element 12 is moved and positioned correctly in the vertical direction towards the shaft 7. In this instance, the other coupling element 17 projects through the side remote from the setting wheels 9. With respect to the other coupling element 17, therefore, the first coupling element 16 is disposed on the side remote from the setting wheels 9 and the two are therefore positioned at the farthest distance apart from one another. A coupling mechanism 15 with the coupling elements 16, 17 comprising it is preferably provided on both side parts 5, 6 of the insert body 2 and on the end regions 19, 20 of the cover element 12 facing them. Furthermore, the shaft 7 preferably extends between the side parts 5, 6 of the insert body 2 and provides a mount for the setting wheels 9.

The first coupling element 16 with its receiving orifice 18 is approximately arch-shaped in this instance and has a preferably flat contact surface 22 on the side facing the join side of the cover element 12, which co-operates with another contact surface 23 on the projection 21 in the coupled position, thereby preventing the cover element 12 from being inadvertently pulled off the insert body 2. To make the joining operation easier, the projection 21 has an oblique lead-in surface as viewed in the coupling or joining direction, thereby facilitating the joining or coupling operation. The two contact surfaces 22, 23 are oriented parallel with the shaft 7. The contact surfaces 22, 23 are also preferably disposed parallel with a printing plane to which the printed image is applied, although this is not illustrated.

In addition to the main body 14, the cover element 12 also has end wall parts 24, 25 covering at least parts of it at its two end regions 19, 20. This being the case, the other coupling element 17 or projection 21 is preferably disposed on these end wall parts 24, 25. To facilitate the joining movement, the end wall part 24, 25 is preferably resiliently connected to the main body 14 of the cover element 12.

The direction of the relative coupling movement which takes place between the coupling elements 16, 17 in the direction of the shaft 7 may take place during the coupling operation due to an appropriate movement of the side parts 5, 6 and/or end wall parts 24, 25. If the components used are plastic, for example made by an injection casting process, this shifting movement may be easily and reliably achieved due to the intrinsic elastic properties of the material. Alternatively, however, it would also be possible to provide regions of weaker at predefined points, which form a sort of hinge, but in the coupled position, the side parts 5, 6 and/or the end wall parts 24, 25 are nevertheless sufficiently strong and stable to maintain their relative position for the co-operating coupling elements 16, 17.

It is also of advantage if at least one guide mechanism 26 is provided between the end wall part 24, 25 of the cover element 12 and the side part 5, 6 of the insert body 2. The purpose of this guide mechanism 26 is to facilitate the joining process and the operation of pushing the cover element 12 onto the insert body 2 on the one hand and to provide additional guidance for positioning purposes relative to the longitudinal axis of the setting wheels disposed on the shaft. Not only does this result in a mutual initial orientation of the components to be joined but also in correct positioning. It also ensures that the cover element 12 and the insert body 2 are exactly guided and supported. At the same time, however, during the process of setting the individual setting wheels 9, forces unintentionally transmitted by the cover element 12 from the cover element 12 to the insert body 2 can also be deflected. An additional restriction of the coupling movement between the cover element 12 and the insert body 2, in particular the housing arch 4, can be obtained by appropriate co-operating guide parts of the guide mechanism 26.

Alternatively, however, it would also be possible for the coupling elements 16, 17 described above to be disposed on the cover element 12 or on the side part 5, 6 in the reverse arrangement or in mirror image with respect to one another. In this case, the receiving orifice 18 would be disposed in the side wall part 24, 25 and the projection 21 on the side part 5, 6.

Figure 4:
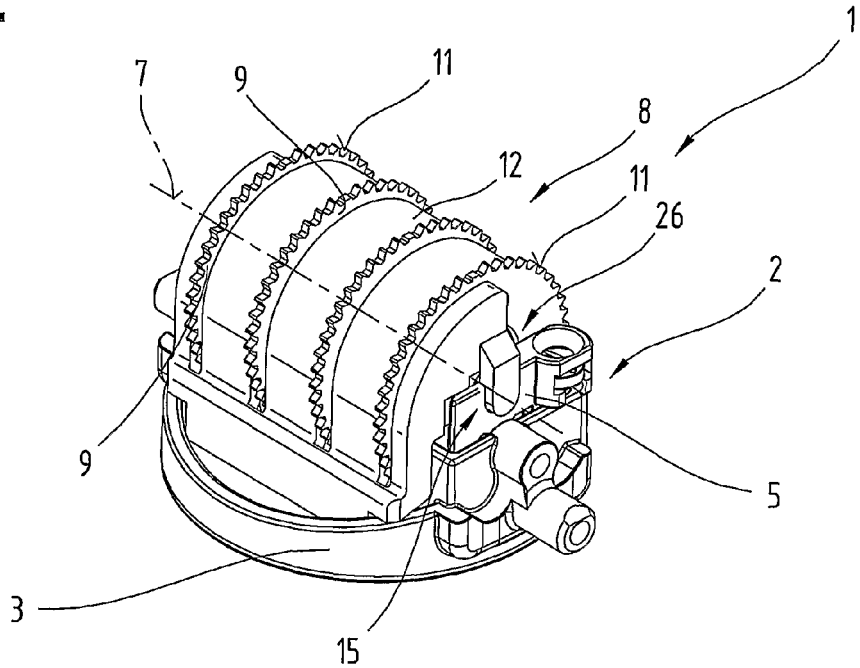
FIG. 4 is a simplified diagram illustrating another insert element for a stamp as proposed by the invention with a coupling mechanism disposed between the cover element and the insert body in the coupled position.
Figure 5:
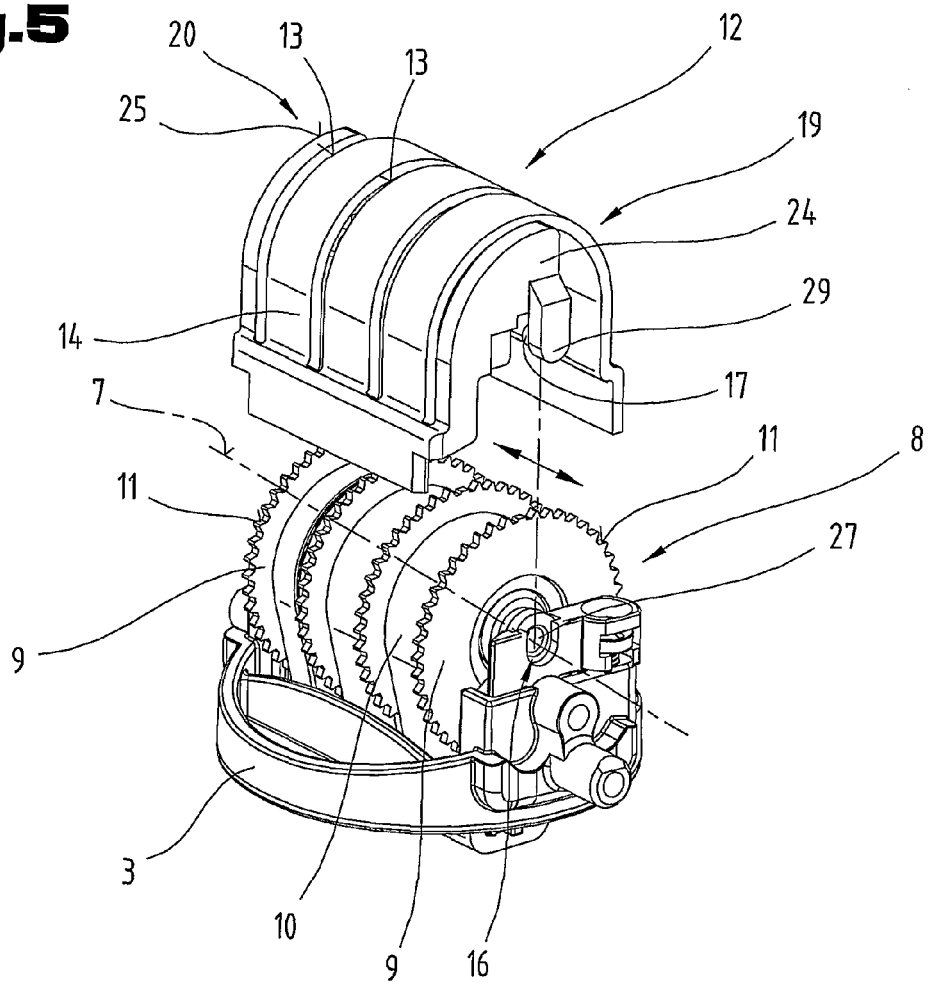
FIG. 5 is a simplified diagram illustrating the insert element shown in FIG. 4 with the cover element removed.
Figure 6:
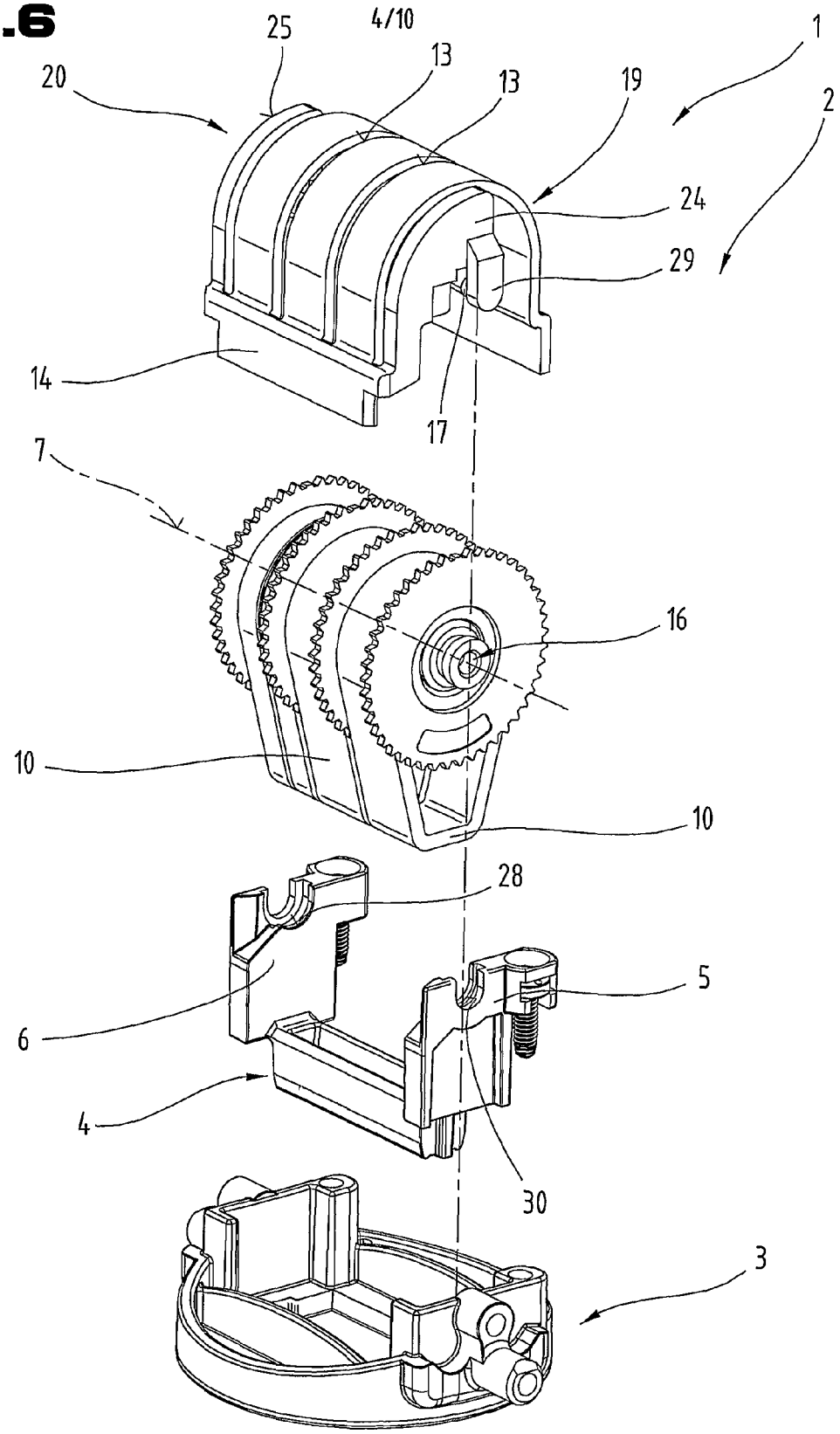
FIG. 6 is a simplified diagram illustrating the insert element shown in FIGS. 4 and 5 in a position with the individual components taken apart from one another.
Figure 7:
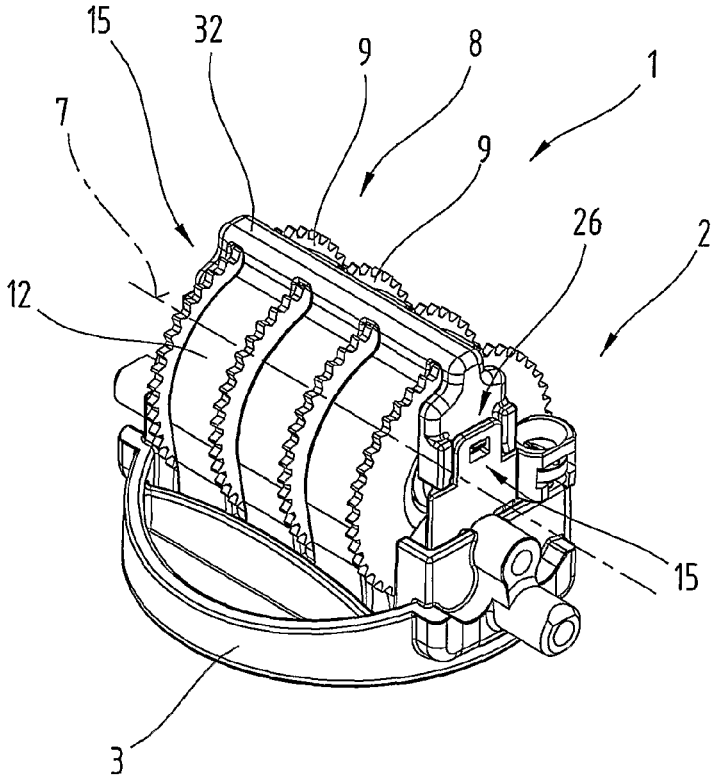
FIG. 7 is a simplified diagram illustrating another insert element for a stamp as proposed by the invention with a coupling mechanism disposed between the cover element and the insert body in the coupled position and an additional connecting web in the apex portion of the cover element.
Figure 10:
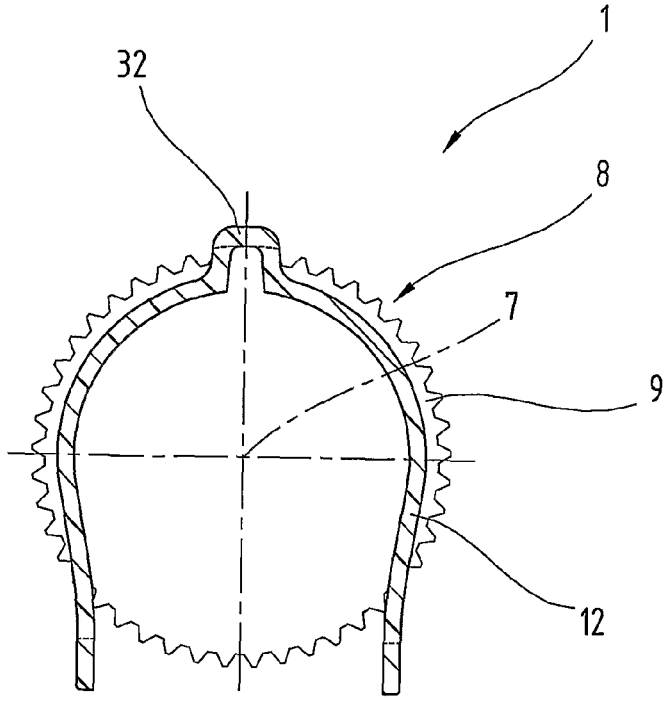
FIG. 10 is a simplified diagram showing a view in section of the cover element illustrated in FIGS. 7 to 9.
Figure 8:
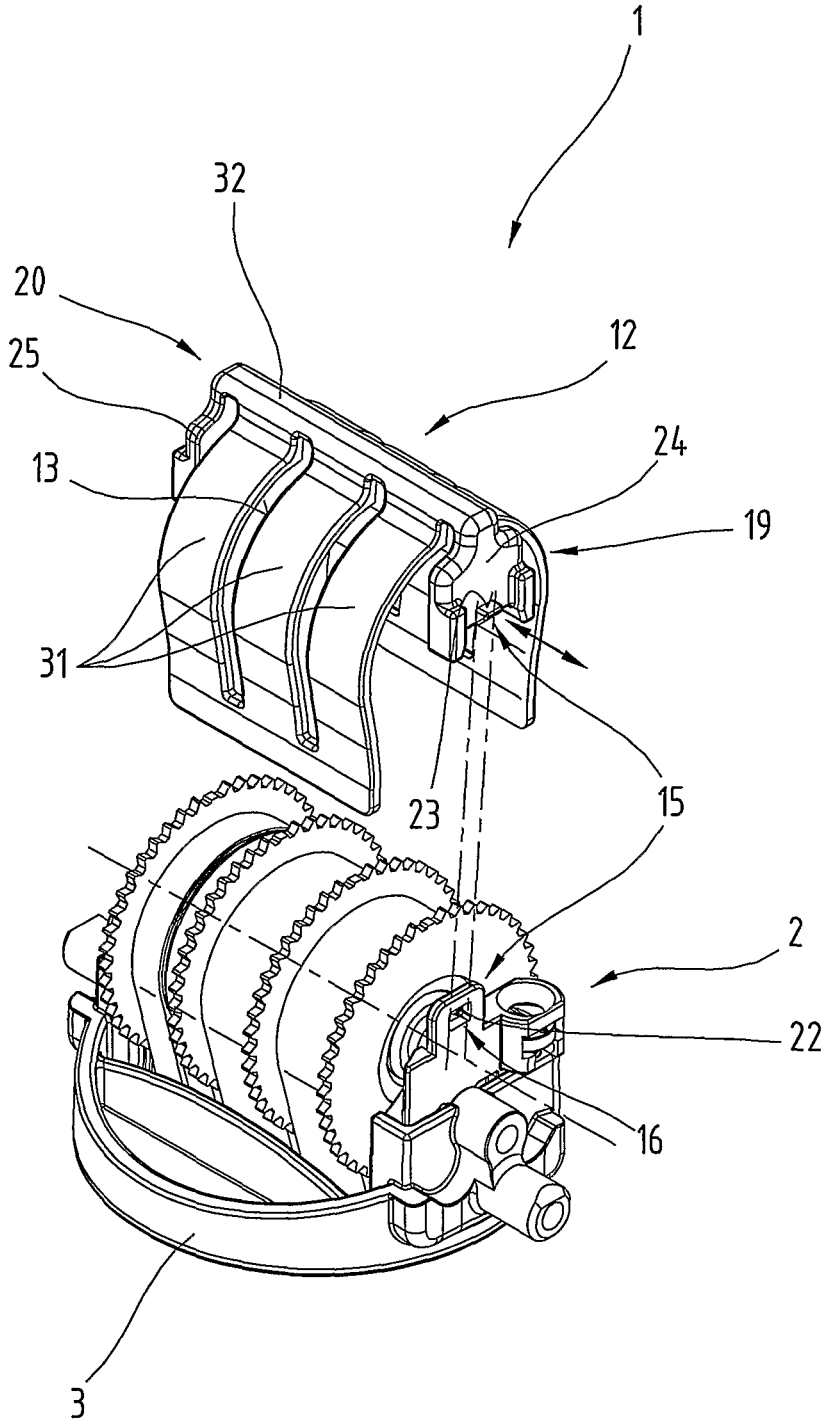
FIG. 8 is a simplified diagram illustrating the insert element shown in FIG. 7 with the cover element removed.
Figure 9:
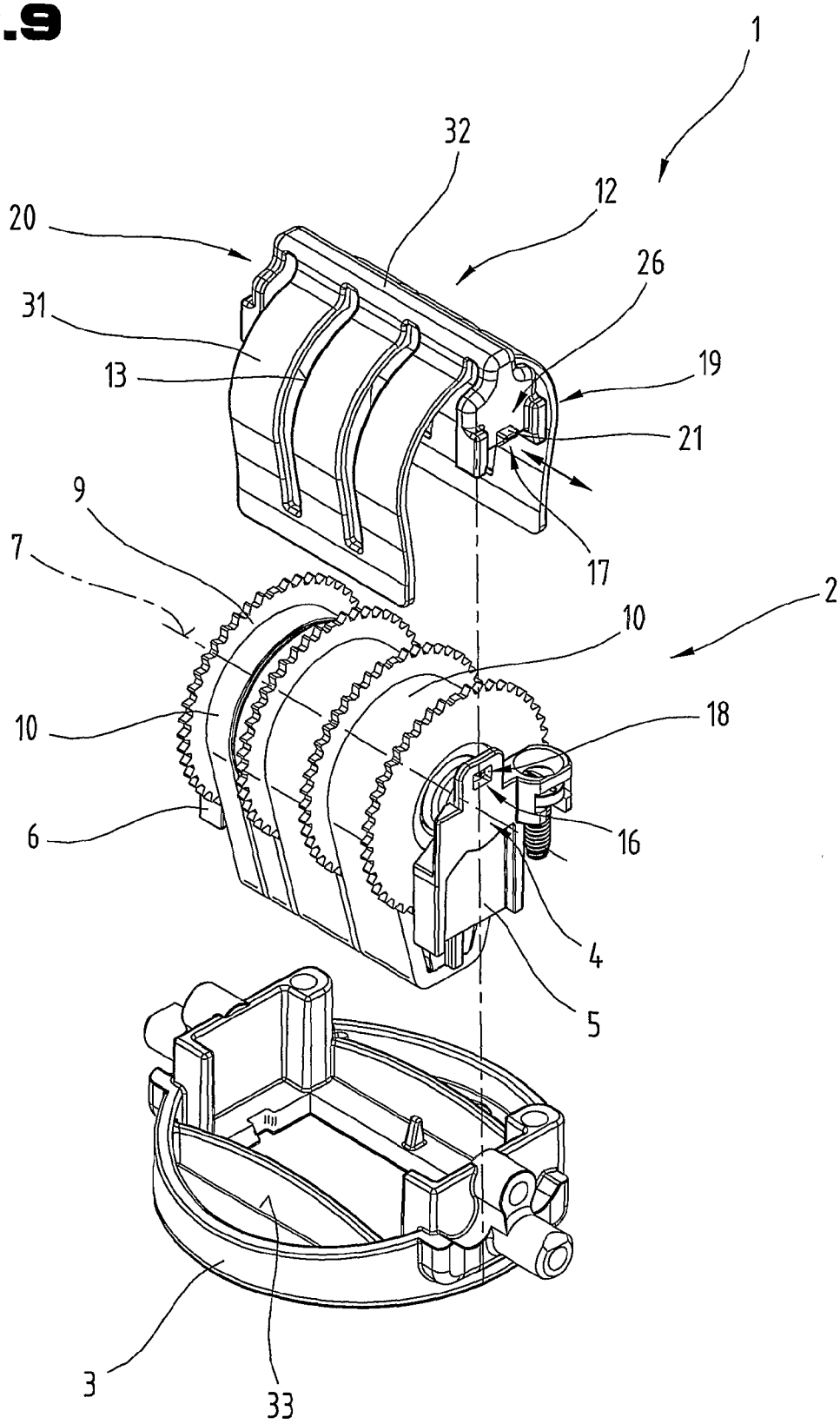
FIG. 9 is a simplified diagram illustrating the insert element shown in FIGS. 7 and 8 in a position with the individual components taken apart from one another.

FIGS. 4 to 6 illustrate another embodiment of the insert element 1 which may be construed as an independent solution in its own right, the same reference numbers and component names being used for parts that are the same as those described in connection with FIGS. 1 to 3. To avoid unnecessary repetition, reference may be made to the more detailed description given above in connection with FIGS. 1 to 3.

The coupling mechanism 15 between the cover element 12 and the insert body 2 illustrated in FIGS. 4 to 6 also has co-operating coupling elements 16, 17, but by contrast with the coupling mechanism 15 illustrated in FIGS. 1 to 3, the first coupling element 16 is provided in the form of a receiving orifice 27 in the shaft 7. The receiving orifice 27 in the shaft 7 is preferably cylindrical. The other coupling element 17 is therefore provided in the form of a cylindrical shoulder projecting in the direction towards the setting wheels 9. In the coupling position, it therefore extends from the outside in the direction towards the shaft 7 and into the receiving orifice 27 provided in it.

Disposed on the side part 5, 6 are approximately half shell-shaped bearing points 28 on the one hand for mounting the shaft 7, and support surfaces 30 on the other hand for supporting a support part 29 of the cover element 12. The support part 29 in this instance serves as an intermediate piece between the end wall part 24, 25 and the pin-type coupling element 17 of the coupling mechanism 15.

A double arrow in FIG. 5 indicates the direction of the coupling movement of the co-operating coupling elements 16, 17 and the coupling operation starts by moving the coupling elements 17 with the support part 29 or side wall part 24, 25 in the direction remote from the setting wheels 9—in other words outwards. It is not until the orientation and position are correct that the coupling element 17 of the cover element 12 comprising the first coupling element 16 can be moved into engagement in the region of the shaft 7. This elastic movement needed for the coupling operation may also be achieved on the basis of the intrinsic properties of the material from which the components are made if they are made from plastic by an injection casting process. However, it would also be conceivable to use other materials, such as metal materials for example, or alternatively fibre-reinforced plastics, in which case care must always be taken to ensure that the direction of the relative coupling movement of the coupling elements 16, 17 with respect to one another by reference to the shaft 7 of the insert body 2 takes place in approximately the direction of the latter.

In all the embodiments described above, the co-operating coupling elements 16, 17 are always disposed centrally at each end. This is usually in the region of the shaft 7 or a plane extending centrally with respect to the U-shaped legs of the main body 14. In the coupled state, the cover element 12 is additionally supported on the support plate 3, thereby resulting in a so-called three-point bearing for the cover element 12 on the insert body 2. The coupling elements 16, 17 described above may co-operate on the basis of a snap-fit connection, in which case they can likewise be oriented in the direction of the shaft 7.

The embodiments illustrated as examples represent possible design variants of the insert element 1, in particular its coupling mechanism 15 between the cover element 12 and the insert body 2, and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

FIGS. 7 to 10 illustrate another embodiment of the insert element 1 which may also be construed as an independent solution in its own right, with an insert body 2 for a stamp, and again, the same reference numbers and component names are used for parts that are the same as those described in connection with FIGS. 1 to 6 above. To avoid unnecessary repetition, reference may be made to the more detailed description of FIGS. 1 to 6 above.

The coupling mechanism 15 between the cover element 12 and the insert body 2 illustrated here works in the same way as coupling mechanism 15, already described in detail with reference to FIGS. 1 to 3. The coupling mechanism 15 again has the co-operating coupling elements 16, 17 on the insert body 2 or one of its component parts and on the cover element 12 respectively. Accordingly, the co-operating coupling elements 16, 17 are designed so that the direction of the relative coupling movement of the coupling elements 16, 17 with respect to one another is oriented approximately in the direction of the shaft 7 of the insert body 2. This means that, by reference to the U-shaped design of the main body 14 of the cover element 12, the direction of the coupling movement extends approximately in the vertical direction relative to the U-shaped cross-section.

In the case of the embodiments of the cover element 12 described above in connection with FIGS. 1 to 6, the slots 13 for accommodating the setting wheels 9 respectively terminate before the ends of the legs of the main body 14, where they are bounded by a web-type component, which is in turn supported on the support plate 3 in the embodiments illustrated in FIGS. 1 to 6.

The cover element 12 in both this embodiment and those described above is formed by individual strip-shaped wall parts 31, between which the slots 13 are formed. These wall parts 31 are connected to one another at each end region of the legs of the main body 14 by a retaining web to form a common component. In order to increase the strength of the wall parts 31 and/or the coupling mechanism 15, the cover element 12 has at least one additional connecting web 32 at least in the region or portion of its apex in the transition region between the legs of the U-shaped component. This connecting web 32 extends in the direction parallel with the shaft 7 between the mutually spaced apart end regions 19, 20 and is connected to the wall parts 31 and preferably continuous. This orientation may also be described as being perpendicular to the cross-section of the cover element 12. In this example of an embodiment, the connecting web 32 is connected not only to the wall parts 31 but also to the side wall parts 24, 25 incorporating or accommodating the coupling elements 17. Accordingly, it may be said that another objective of the invention is to propose a cover element 12 to which higher strength is imparted, in particular in the region of its individual wall parts 31 separated from one another by the slots 13. As a result, the cover element 12 as a whole is capable of withstanding greater stress. This stress on the cover element 12 may be caused by the design of the coupling mechanism 15 and the way it operates as well as during the process of fitting it on the insert body and during the process of setting the individual setting wheels 9. This objective is therefore achieved independently of the design of the coupling mechanism 15. It is also possible to provide a plurality of connecting webs 32 across the extension of the slots 13 as viewed in the cross-section of the element 12.

The connecting web 32 extends in a radial direction by reference to the setting wheels 9 across a greater distance between the end regions 19, 20 or end wall parts 24, 25, which is selected so that the setting wheels 9 can be accommodated unobstructed and are thus able to move on the one hand and so that the individual wall parts 31 can be retained on the region of the setting wheels 9 remote from the shaft 7 on the other hand. Accordingly, the setting wheel circumferences 11 of the setting wheels 9 are bridged by the connecting web 32, which is held at a radial distance apart. This enables the individual setting wheels 9 to be accommodated in the region of the connecting web 32 without contact. This connecting web 32 may likewise be U-shaped as viewed in cross-section—in other words in the direction of its longitudinal extension or in the direction of the shaft 7—as may best be seen from FIG. 10. Accordingly, the connecting web 32 is raised relative to an external surface of the individual wall parts 31 and extends above this surface at the side or in the direction remote from the shaft 7. As a result, in addition to providing a strong coupling mechanism 15, high strength is also imparted to the cover element 12 as a whole in its apex portion. It is therefore possible to opt for slim wall thicknesses in spite of imparting sufficient strength to both the cover element 12 and the coupling mechanism 15 provided on it.

The connecting web 32 with the wall parts 24, 25 disposed on it or connected to it is also of a U- or C-shaped design, but is disposed offset from the U-shaped cover element 12 by 90°. In the case of both of the U-shaped components, the legs or end wall parts 24, 25 extend in the same direction.

The end wall parts 24, 25 in turn bear the coupling elements 17 described above whilst simultaneously serving as the guide mechanism 26 to provide the correct orientation with respect to the housing arch 4.

As a result of this additional connecting web 32, the side wall parts 24, 25 are able to deform as viewed in the direction of the shaft 7 in order to move the coupling elements 16 respectively 17 into and out of engagement with one another. To this end, a gap is formed between the end wall parts 24, 25 and the directly adjacent wall parts 31, which, in terms of its internal width, may correspond to the slot width of the slots 13 for accommodating the respective setting wheels 9 or alternatively be slightly bigger. This will depend on the disposition and design of the coupling elements 16 on the housing arch 4 and the side parts 5, 6. If a slightly wider or bigger gap is selected, the coupling operation between the two co-operating coupling elements 16, 17 is easier. Providing the connecting web 32, however, means that the requisite strength of the entire cover element 12 is nevertheless obtained in this region and is so in particular for its coupling mechanism 15 as well.

By contrast with the embodiments of the cover element 12 described above, the side wall parts 24, 25 in this instance are moved or pivoted about a pivot region disposed centrally in the apex portion of the cover element 12 by inwardly pivoting the two end wall parts 24, 25. In the embodiments described above with reference to FIGS. 1 to 6, the side wall parts 24, 25 are pivoted about a pivot region disposed in the region of the leg ends. By reference to the cross-section-plane of symmetry of the U-shaped cover element 12 and its wall parts 31, this results in an eccentric movement or pivoting action of the end wall parts 24, 25 during the coupling operation.

The ends of the wall parts 31 remote from the connecting web 32 in the region of the leg ends of the U-shaped cover element 12 may in turn be joined to one another to form an integral component. This in turn improves the strength of the individual wall parts 31, in particular to prevent deformation in this region. The leg ends of the cover element 12 in the region of the wall parts 31 project through the support plate 3 inside of a web 33. This prevents any inadvertent splaying of the legs of the U-shaped cover element 12 in this region. In addition, however, it would also be possible to provide some other appropriate support and thus strengthen the cover element 12 with respect to the support plate 3 relatively speaking.

In order to fit the cover element 12 on the housing arch 4, the cover element 12 is pushed over the setting wheels 9 due to the elastic splaying of the legs of the cover element 12. This pushing-in movement continues until the coupling elements 16, 17 of the coupling mechanism 15 engage with one another. This pushing-on movement is made easier due to the guide mechanism 26 in the region of the side wall parts 24, 25 and housing arch 4 described above. A stop to restrict the pushing-in movement may also be provided in the region of the guide mechanism 26, which may best be seen in FIG. 7. The components or webs of the guide mechanism 26, which are disposed in the region of the end wall parts 24, 25, are supported on co-operating support surfaces or support edges on the housing arch 4 and its side parts 5, 6.

Figure 11:
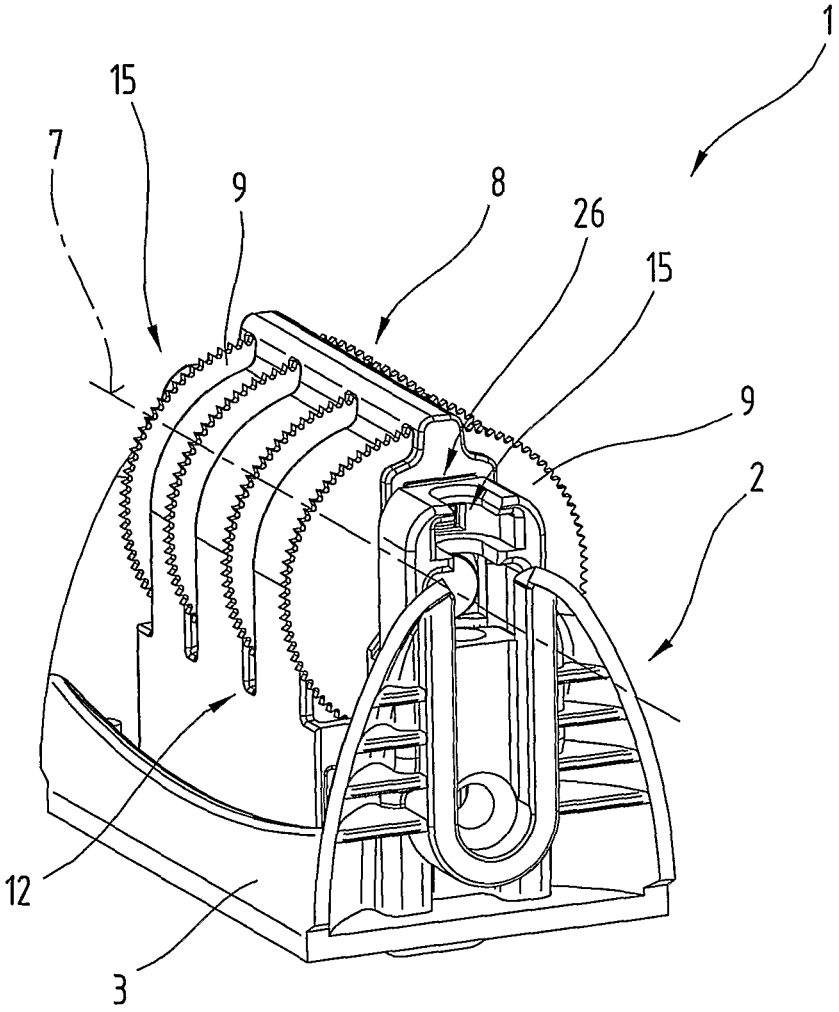
FIG. 11 is a simplified diagram illustrating another insert element for a stamp as proposed by the invention with a coupling mechanism disposed between the cover element and the insert body in the coupled position and an additional connecting web in the apex portion of the cover element.
Figure 12:
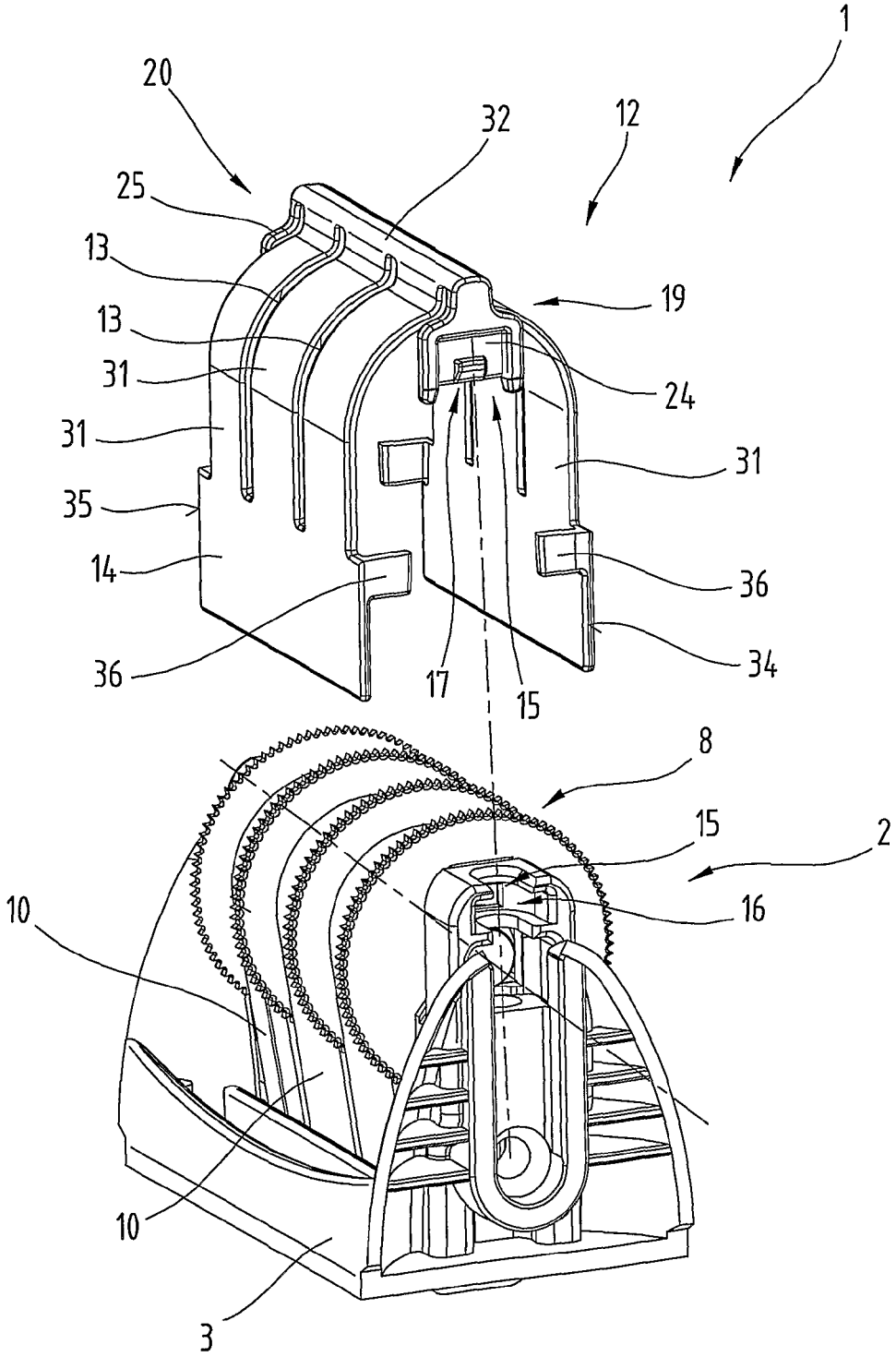
FIG. 12 is a simplified diagram illustrated the insert element shown in FIG. 11 with the cover element removed.
Figure 13:
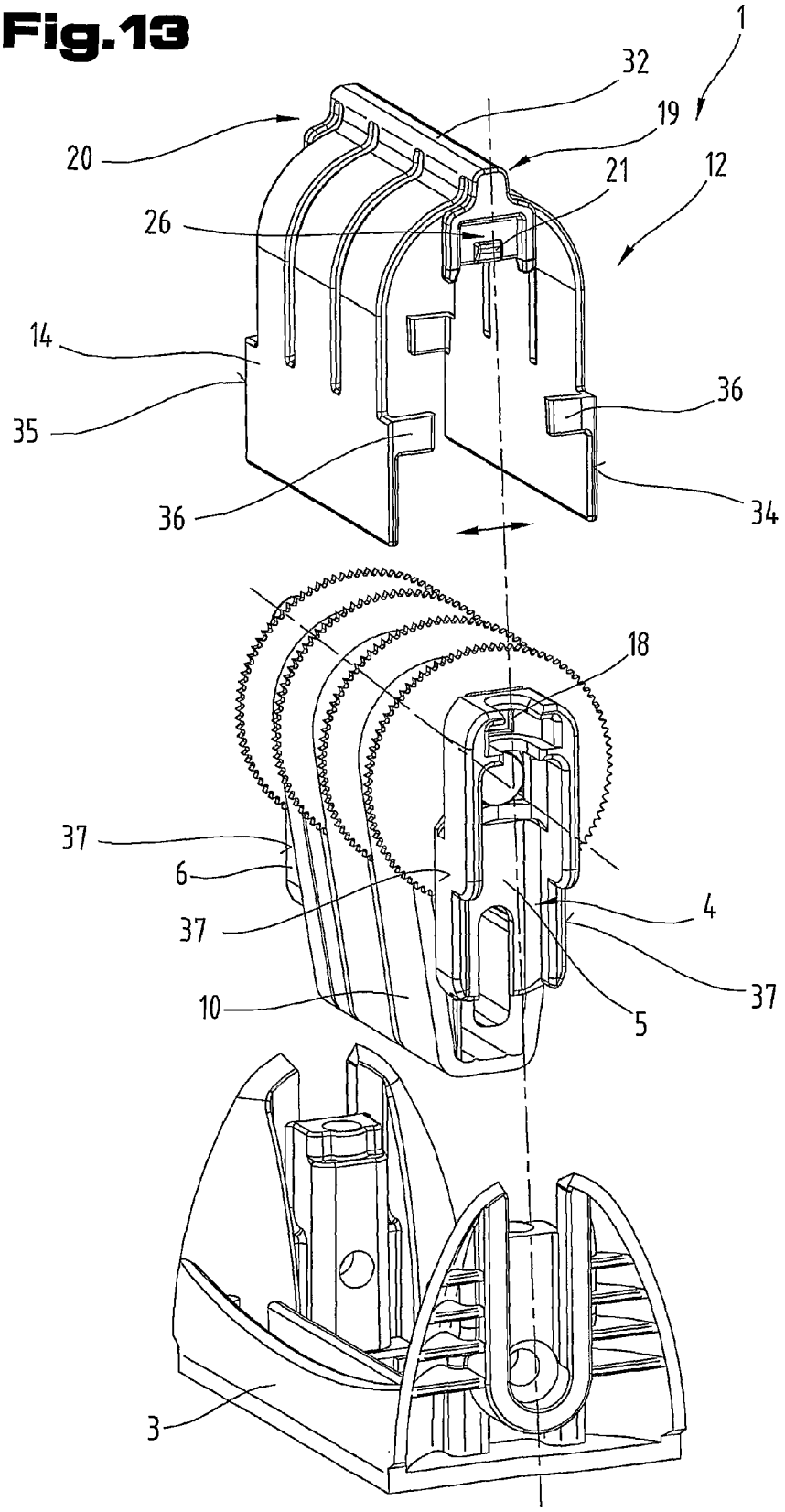
FIG. 13 is a simplified diagram illustrating the insert element shown in FIGS. 11 and 12 in a position with the individual components taken apart from one another.

FIGS. 11 to 13 illustrate another embodiment of the insert element 1 which may be construed as an independent solution in its own right, with an insert body 2 for a stamp, the same reference numbers and component names being used to denote parts that are the same as those used to describe FIGS. 1 to 10 above. To avoid unnecessary repetition, reference may be made to the more detailed description given above in connection with FIGS. 1 to 10.

The coupling mechanism 15 between the cover element 12 and the insert body 2 illustrated here works in the same way as coupling mechanism 15, already described in detail with reference to FIGS. 1 to 3 and 7 to 10. No further explanation will therefore be given.

At its mutually spaced apart end regions 19, 20 in the direction of the shaft 7, the cover element 12 forms end faces 34, 35 or side ends on which mutually facing support elements 36 are disposed. The purpose of these support elements 36 is to ensure that the cover element 12 is supported on a specifically provided contact region 37 in the fitted state positioned on the housing arch 4. This serves as a fitting aid, by means of which assembly of the unit comprising the housing arch 4, setting wheel unit 8 and cover element 12 with the support plate 3 is made easier. It would also be possible for the support elements 36 to be provided with additional support on the support plate 3 or a component of it as viewed in the pushing-in direction, thereby resulting in an additional restriction of the pushing-in movement of the cover element 12 relative to the support plate 3. This not only prevents the U-shaped cover element and in particular its wall parts 31 from springing inwards but also enables the cover element 12 to be exactly positioned relative to the support plate 3 and the setting wheel unit 8.

As a result of the guide mechanism 26, the cover element 12 is also moved accurately into its position in its apex portion relative to the setting wheel unit 8 and support plate 3. This enables the individual typeface belts 10 to be moved by the setting wheels 9 unobstructed.

For the sake of good order, finally, it should be pointed out that, in order to provide a clearer understanding of the structure of the insert element 1, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2, 3; 4, 5, 6; 7, 8, 9, 10; 11, 12, 13 constitute independent solutions proposed by the invention in their own right. The objectives and associated solutions proposed by the invention may be found in the detailed descriptions of these drawings.

LIST OF REFERENCE NUMBERS

1 Insert element
2 Insert body
3 Support plate
4 Housing arch
5 Side part
6 Side part
7 Shaft
8 Setting wheel unit
9 Setting wheel
10 Typeface belt
11 Setting wheel circumference
12 Cover element
13 Slot
14 Main body
15 Coupling mechanism
16 Coupling element
17 Coupling element
18 Receiving orifice
19 End region
20 End region
21 Projection
22 Contact surface
23 Contact surface
24 End wall part
25 End wall part
26 Guide mechanism
27 Receiving orifice

28 Bearing point
29 Support part
30 Support surface
31 Wallpart
32 Connecting web
33 Web
34 End face
35 End face
36 Support element
37 Contact region

The invention claimed is:

1. An insert element for a stamp, comprising:

a plurality of setting wheels disposed adjacent to one another, which are rotatably mounted on a shaft of an insert body, and the setting wheels are designed to support typeface belts, a cover element covering the typeface belts at least in the region of the setting wheels, the cover element comprising a main body with a U-shaped cross section by reference to the shaft with end regions with end wall parts spaced apart from one another in the direction of the shaft, at least one continuous connecting web essentially extending between the spaced apart end regions disposed at least in an apex region of the U-shaped main body, and a curved portion of the U-shaped main body essentially extends along a circumferential region of the setting wheels, and the cover element is provided with slots through which setting wheel circumferences extend, at least one coupling mechanism for coupling the cover element with the insert body, which coupling mechanism comprises a first coupling element on the insert body and a second coupling element on the cover element co-operating therewith, the first and second coupling elements are designed so that the direction of the relative coupling movement of the first and second coupling elements with respect to one another is oriented approximately in the direction of the shaft of the insert body; and a guide mechanism provided between the end wall part of the cover element and a side part of the insert body.

2. The insert element as claimed in claim 1, wherein the first coupling element is provided in the form of a receiving orifice in the region of a side part of the insert body.

3. The insert element as claimed in claim 1, wherein the second coupling element is provided in the form of a projection in the region of the end regions of the cover element spaced apart from one another in the direction of the shaft.

4. The insert element as claimed in claim 1, wherein the second coupling element is designed so that it projects through the side facing the setting wheels.

5. The insert element as claimed in claim 1, wherein the first coupling element is disposed on the side remote from the setting wheels by reference to the second coupling element.

6. The insert element as claimed in claim 1, wherein the second coupling element is designed to project in the direction away from the setting wheels.

7. The insert element as claimed in claim 1, wherein the first coupling element is disposed on the side remote from the setting wheels by reference to the second coupling element.

8. The insert element as claimed in claim 1, wherein the first and second coupling elements each have co-operating contact surface, which are oriented parallel with the shaft.

9. Insert element as claimed in claim 1, wherein the second coupling element is disposed on an end wall part in the end region of the cover element.

10. The insert element as claimed in claim 9, wherein the end wall part is resiliently connected to the main body of the cover element.

11. The insert element as claimed in claim 9, wherein the end wall part is connected to a leg end of the cover element.

12. The insert element as claimed in claim 1, wherein the connecting web has a U-shaped cross-section and extends above the wall parts towards the side remote from the shaft.

13. The insert element as claimed in claim 1, wherein the connecting web is connected to the end wall parts and/or regions between the slots of the U-Shaped main body of the cover element.

14. The insert element as claimed in claim 1, wherein the cover element has support elements directed towards one another starting from the main body on its side ends spaced apart from one another in the direction of the shaft.

15. The insert element as claimed in claim 14, wherein when the coupling mechanism is in the coupled position, the support elements are respectively supported on a contact region formed on a support plate or a housing arch of the insert body.

16. The insert element as claimed in claim 1, wherein a coupling mechanism is provided respectively on both side parts of the insert body and on the end regions of the cover element facing them.

17. The insert element as claimed in claim 1, wherein the shaft extends between the side parts of the insert body.

* * * * *